US006807889B2

(12) United States Patent
Pollien

(10) Patent No.: US 6,807,889 B2
(45) Date of Patent: Oct. 26, 2004

(54) BLANKING PLATEN IN A SHAPING PRESS

(75) Inventor: Jean-Francois Pollien, Penthaz (CH)

(73) Assignee: Bobst S.A. (CH)

( * ) Notice: Subject to any disclaimer, the term of this patent is extended or adjusted under 35 U.S.C. 154(b) by 48 days.

(21) Appl. No.: 09/847,671

(22) Filed: May 2, 2001

(65) Prior Publication Data

US 2002/0007715 A1 Jan. 24, 2002

(30) Foreign Application Priority Data

May 8, 2000 (CH) ..... 0894/00

(51) Int. Cl.[7] ..... B26D 7/26
(52) U.S. Cl. ..... 83/655; 83/699.31
(58) Field of Search ..... 83/655, 699.31, 83/699.41, 698.71

(56) References Cited

U.S. PATENT DOCUMENTS

| | | | | | |
|---|---|---|---|---|---|
| 1,787,816 | A | * | 1/1931 | Ditchfield | 83/699.41 X |
| 1,939,478 | A | * | 12/1933 | Whistler | 83/699.41 X |
| 2,009,660 | A | * | 7/1935 | Irmis | 83/698.71 X |
| 3,062,083 | A | | 11/1962 | Strand | |
| 3,113,515 | A | | 12/1963 | Bogardus et al. | |
| 3,357,288 | A | | 12/1967 | Ventre et al. | |
| 3,982,458 | A | * | 9/1976 | Terasaka | 83/698.71 X |
| 4,014,232 | A | * | 3/1977 | Mauger | 83/698.71 X |
| 4,258,620 | A | * | 3/1981 | Sallander | 83/698.71 X |
| 4,541,828 | A | * | 9/1985 | Polic | 83/698.71 X |
| 4,590,788 | A | * | 5/1986 | Wallis | 83/698.71 X |
| 5,072,507 | A | * | 12/1991 | Meeks | 83/698.71 X |
| 5,644,979 | A | | 7/1997 | Raney | |
| 5,730,039 | A | * | 3/1998 | Holliday et al. | 83/699.41 |

FOREIGN PATENT DOCUMENTS

| | | |
|---|---|---|
| DE | 93 08 628 | 8/1993 |
| EP | 0 355 673 | 2/1990 |
| EP | 0 764 501 | 3/1997 |
| GB | 2 247 205 | 2/1992 |
| GB | 2 337 224 | 11/1999 |

* cited by examiner

*Primary Examiner*—Charles Goodman
(74) *Attorney, Agent, or Firm*—Ostrolenk, Faber, Gerb & Soffen, LLP

(57) ABSTRACT

The cutting plate of a press for shaping sheets of paper or cardboard comprises a bottom beam receiving a support plate (1) on which a metal cutting plate (7) is placed, the support plate (1) has means for adjusting its position in a horizontal plane and means for fixing the cutting plate (7). The support plate (1), on a first side thereof, has at least one moving stirrup (15, 16), the said moving stirrup being adapted to take up a clamping position where it prevents the cutting plate (7) from sliding on the support plate (1) and an inoperative position where it enables the cutting plate (7) to slide on the support plate (1). The side opposite the first side and one of the adjacent sides are provided with at least one fixed stirrup (10, 11, 12, 13, 14) disposed so that portions of the edge of the cutting plate (7) can be slid into the said fixed stirrups and be gripped under the moving stirrups in the clamping position.

13 Claims, 3 Drawing Sheets

BLANKING PLATEN IN A SHAPING PRESS

The invention relates to a blanking platen of a press for shaping sheets of paper or cardboard, comprising a bottom beam receiving a support plate on which a metal cutting sheet can be placed, the support plate comprising means for adjusting its position in a horizontal plane and means for fixing the support plate.

For each run, presses for shaping sheets of paper, solid fibreboard or corrugated cardboard use a specific set of shaping tools for a given job. A typical set of tools comprises:

a make-ready sheet, a support member, a top ejection member, a bottom ejection board, a top blank-separating tool, a bottom blank-separating tool, and if required, a front waste separator.

The set of tools must be disposed extremely accurately in the various stations of the press at the beginning of each job. In the case of short runs in particular, the productivity of the unit depends closely on the speed with which the tools are positioned and adjusted.

In a blanking platen of the kind defined in the preamble, the metal cutting plate can be used as a support for corresponding scoring parts co-operating with scoring rules mounted on the support member. In this case the cutting plate may be considered as an additional shaping tool. The co-operating parts opposite the scoring rules must be positioned extremely accurately and this operation needs to be optimised, like the adjustment of the other tools.

The support plates in existing presses are often provided with a device for micrometric adjustment of the longitudinal position of the plate with respect to the beam. The cutting plate is screwed to the support plate by four screws at the four corners.

The screw holes have an oblong clearance or configuration and enable the position of the cutting plate on the support plate to be adjusted by about 1 mm, thus enabling the position of the grooves of the corresponding scoring parts opposite the scoring rules to be accurately adjusted in the longitudinal and transverse directions.

The terms "longitudinal" and "transverse" referring to movement and "front", "rear" and "lateral" referring to a side of the support plate or of the cutting sheet are used here with reference to the direction of advance of the sheets in the machine.

However this adjustment takes a long time, since during each movement of the cutting plate during adjustment, it is necessary to remove the support plate completely from the cutting station, loosen the four screws with a screwdriver, slide the cutting plate a short distance, then tighten the four screws and return the support plate to the station in order to make a positioning test. It is generally necessary to perform these operations several times.

SUMMARY OF THE INVENTION

The object of the invention is to enable the cutting plate to be fixed and micrometrically adjusted in position much more quickly than the operation described hereinbefore.

To this end, in the case of a platen of the kind defined in the preamble, the support plate on a first side thereof comprises at least one moving stirrup, the moving stirrup being adapted to take up a clamping position where it prevents the cutting plate from sliding on the support plate and an inoperative position where it enables the cutting plate to slide on the support plate, whereas on the side opposite the first side and on an adjacent side, the support plate comprises at least one respective fixed stirrup disposed so that edge portions of the cutting plate can be slid into the fixed stirrup and be gripped under the moving stirrup in the clamping position.

When the moving stirrup is placed in the inoperative position, the cutting plate can be moved by sliding on the support plate. The cutting plate can also be moved by at least 1 mm in any direction while remaining engaged in the fixed stirrups, which is sufficient for precise adjustment of the position thereof. The operations of clamping and releasing the support plate from the moving stirrup are much quicker than tightening and loosening four screws. There is no need for the support plate to be completely taken out and returned several times to the cutting station.

The fixed stirrups can be rules having a protruding upper lip on which the cutting plate slides.

Preferably the support plate has two moving stirrups on the side near the operator, i.e. the side usually accessible by the operators. The side opposite the operator comprises two or more fixed stirrups. Likewise the rear of the support plate can comprise two or more fixed stirrups in the form of rules. The front of the support plate can carry one or more abutments.

The moving stirrup or stirrups can be mounted on a moving push rod which can be manually actuated so as to counteract the force of a return spring and raise and rotate the moving stirrup by a fraction of a revolution, moving from the inoperative position to the clamping position.

This operation can be carried out via a milled button. The cutting plate can be clamped by additional rotation of the milled button. It is thus unnecessary to use manual tools such as screwdrivers or spanners.

On its bottom surface, the support plate can be formed with a set of grooves and through-holes, connected to an air suction device. The cutting plate is thus pressed and held against the support plate by partial evacuation.

Preferably the moving stirrups are retracted into recesses in the support plate when they are rotated into the inoperative position. This enables the cutting plate to be positioned and removed by sliding it on the support plate.

The system for micrometric adjustment of the support plate, on each lateral edge of the plate, can comprise means for micrometric adjustment of its longitudinal position. The means can comprise a milled knob mounted in a block secured to the respective side edge, acting on a fixed abutment of the machine via a lug movable in the longitudinal direction and thus controlling the longitudinal position of the support plate. In a preferred embodiment, the lateral edge of the support plate near the operator can bear a second milled knob acting on a fixed abutment of the platen via a lug which moves transversely, adjusting the transverse position of the support plate, also starting from the cutting plate without unclamping it.

Other properties and advantages of the device according to the invention will be clear to the skilled man from the following description of a preferred embodiment in connection with the drawings, in which:

DESCRIPTION OF A PREFERRED EMBODIMENT

Figure 1:
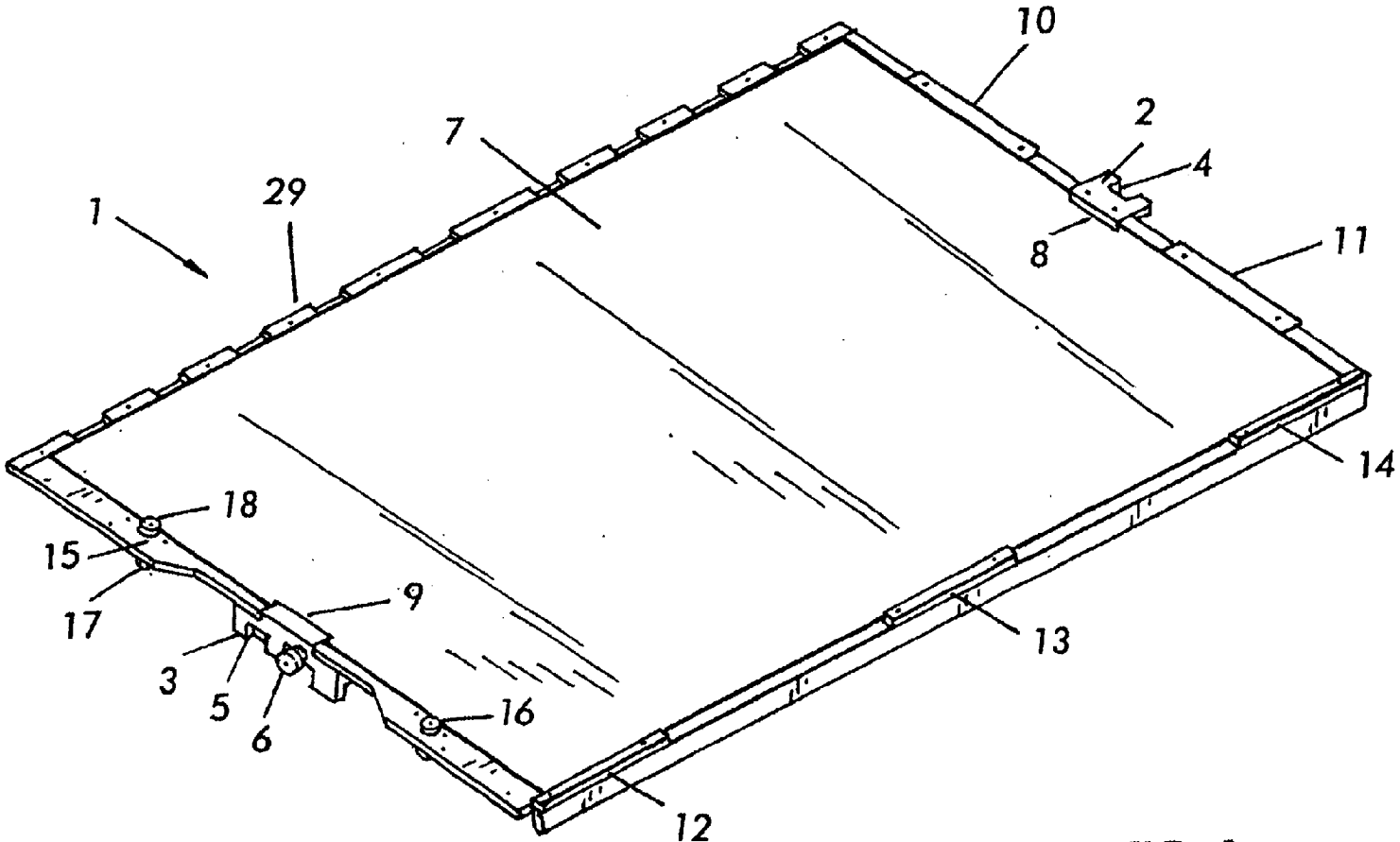
FIG. 1 is a view in isometric projection of a support plate and a cutting plate.

FIG. 1 shows a support plate 1 which has a thickness of 4 to 5 mm and on which a thin metal cutting plate 7 is placed. The support plate comprises devices for micrometric adjustment of its position in a horizontal plane. Two micrometric adjustment blocks 2 and 3 are fixed in the middle between the two side edges of the support plate and project slightly from the top surface thereof. The block 2, situated on the side remote from the operator, comprises a milled knob 4 acting on a lug (not shown in FIG. 1) movable along a longitudinal axis. The lug abuts a fixed catch on the platen and thus defines the longitudinal position of the edge of the support plate remote from the operator. The micrometric adjustment block 6 situated towards the operator also comprises a milled knob 5 acting on a longitudinally movable lug (not shown on the drawing) which abuts against a fixed catch on the platen in order to define the longitudinal position of the operator-side edge of the support plate. The micrometric adjustment block 3 on the operator side comprises a second milled knob 6 acting on a transverse displacement lug situated under the plate (not shown in FIG. 1) and abutting against a third catch on the platen and thus determining the transverse position of the plate 1 in the machine.

The cutting plate 7 is a thin rectangular plate of stainless steel 1 mm thick. It comprises two rectangular notches 8, 9 for receiving the projecting parts of the micrometric adjustment blocks 2 and 3. A clearance can be provided between the notches and the edges of the blocks.

On the side remote from the operator, the support plate has two fixed stirrups 10 and 11. Each fixed stirrup 10, 11 has an upper lip facing the interior of the support plate and co-operating therewith to form a groove of equal or slightly greater thickness than the cutting plate, so that the corresponding edge of the cutting plate can be received therein. The edge of the support plate at the rear, i.e. the platen inlet, comprises a similar fixed stirrup 12. The front edge of the support plate is formed with a number of rectangular notches 29 for engaging the grippers on a sheet-conveying bar (not shown).

Figure 3:
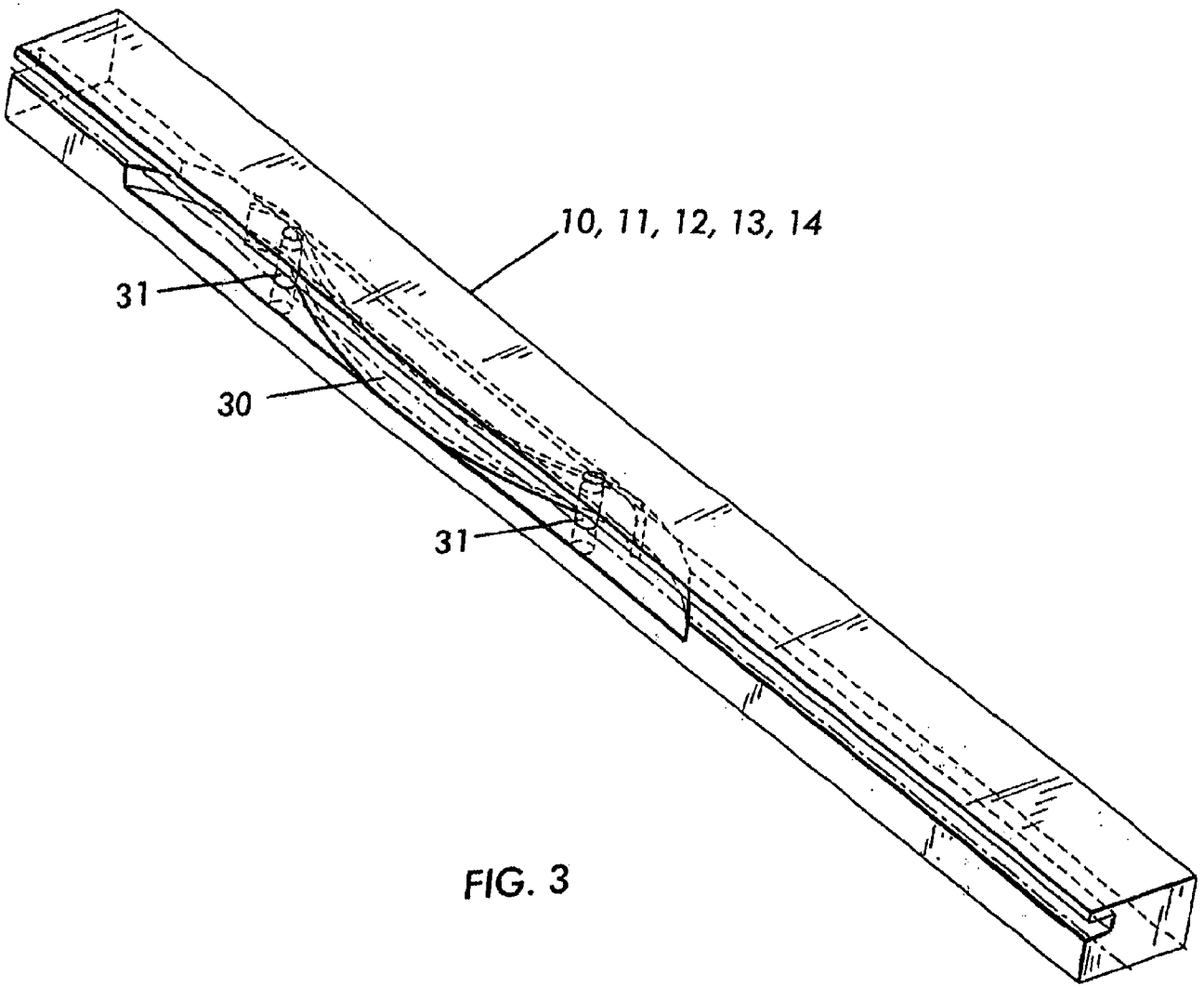
FIG. 3 is a perspective view of a fixed stirrup.

Spring strips 30 in the stirrups 10, 11, 12, 13 and 14 (see FIG. 3) are positioned by pins 31, the object being to push the cutting plate transversely in the "side remote from operator —operator's side" direction and longitudinally in the "cardboard advance" direction. The cutting plate is thus automatically and correctly positioned in the stirrups.

In another embodiment, the fixed stirrups 12, 13 and 14 may advantageously be replaced by a single fixed stirrup (not shown) extending over the entire width of the support plate 1.

Figure 2:
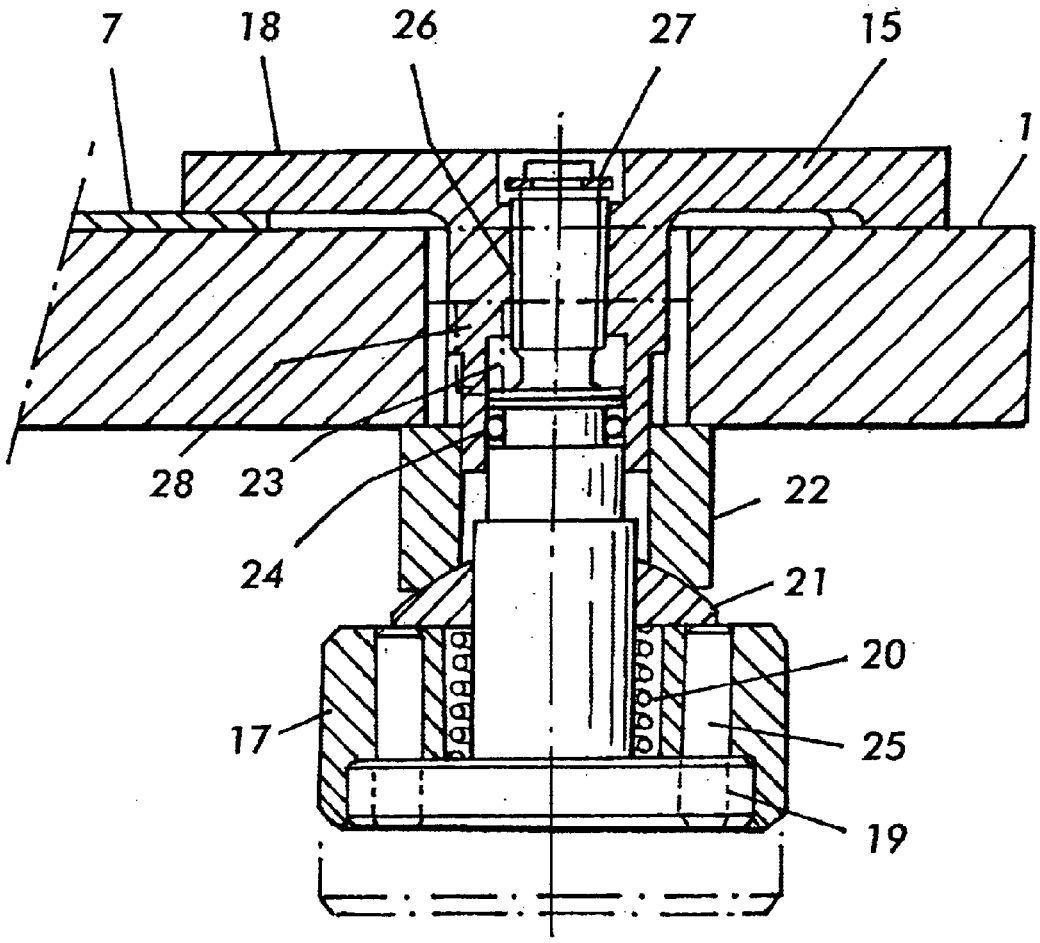
FIG. 2 is a detail showing a moving stirrup in vertical section.

On the side near the operator, the support plate on its top surface has two rectangular recesses extending in the longitudinal direction and vertically prolonged by two through openings for engaging two moving stirrups 15, 16. The moving stirrups 15, 16, seen from above, having a generally rectangular shape corresponding to a recess, and are prolonged downwards by a hollow cylindrical part 28 corresponding to an opening, shown on FIG. 2. The moving stirrups 15 and 16 are each mounted on a moving push-rod device and can thus each rotate around a vertical axis and undergo limited vertical translation along the said axis. FIG. 2 shows the stirrup 15 in the clamped position. One end 18 of the stirrup 15 imprisons the edge of the cutting sheet 7 whereas the other and rather thicker end of the stirrup rests on the support plate 1. The stirrup 15 can thus be raised by vertically pressing a button 19, thus counteracting the force of a spring 20. A spherical surface of a part 21 holding the spring 20 comes in contact with a cone 22 mounted on the bottom surface of the support plate 1. In the compressed position of the spring 20, rotation of the button 19 results in rotation of the stirrup 15, and the inner surface of an inner bore 23 in the cylindrical part 28 of the stirrup 15 rubs against an 0-ring 24 of synthetic material mounted in a groove on the shaft of the button 19.

In the position shown in FIG. 2, after the vertical push on the button 19 has been relaxed, the milled part 17 secured to the head of the button 19 rotates on two pins extending through two bores 25, thus clamping or unclamping the cutting plate from the stirrup 15, via the threaded part 26 joining the button 19 to the stirrup 15. A ring 27 limits the extent to which parts can be unclamped.

When the cutting plate is positioned on the support plate, the cutting plate is first slid on to the support plate and the rectangular notch 9 is placed in abutment against the projecting part of the micrometric adjustment block 3. During this operation, the stirrups 15, 16 are retracted into the appropriate recess in the support plate. The moving push rods push the stirrups 15 and 16, which are raised and rotated by a quarter revolution in order to grip the cutting plate and are then clamped. The operator can then micrometrically adjust the position of the support plate by acting on the three milled knobs 4, 5, 6 described hereinbefore.

What is claimed is:

1. A blanking platen of a press for shaping sheets, comprising:

a bottom beam;

a support plate on the beam, the support plate having a plurality of sides, the support plate being adapted to receive a metal cutting plate having a plurality of edges, the support plate comprising a first adjusting device for adjusting the position of the support plate on the beam, the support plate being structured to permit the cutting plate to be moved on the support plate in any direction, beyond tolerances of the support plate, within a plane parallel to the support plate; and a second adjusting device for fixing the position of the cutting plate on the support plate, the second adjusting device comprising at least one moving stirrup on a first side of the support plate, the moving stirrup including a moveable clamping part which is movable between a clamping position at which the stirrup prevents the cutting plate from sliding on the support plate and an inoperative position at which the stirrup enables the cutting plate to slide on the support plate, and a respective fixed stirrup on a second side of the support plate opposite the first side and also on a third side of the support plate, the fixed stirrups being shaped and positioned so that first and second edges of the cutting plate may be slid into the fixed stirrups and a third edge of the cutting plate may be gripped under the moving stirrup in the clamping position thereof.

2. The platen of claim 1, wherein the support plate comprises two of the moving stirrups disposed on the first side of the support plate and each moving stirrup is movable between the positions thereof.

3. The platen of claim 2, further comprising a plurality of the fixed stirrups on the second side of the support plate and a plurality of the fixed stirrups on the third side of the support plate.

4. The platen of claim 1, wherein the moveable clamping part of the moving stirrup includes a cutting plate gripping part;

a movable push rod connected with the movable clamping part for moving the clamping part to the inoperative position thereof; and biasing means for supplying a force to counteract the force of the push rod and to move the clamping part to the clamping position, and while the push rod moves the clamping part off the cutting plate, the clamping part is in its inoperative position, and the biasing means enables the movable stirrup to move between the inoperative and the clamping positions thereof.

5. The platen of claim 4, wherein the movable clamping part is rotatable between the inoperative position and the operative position when the push rod moves the clamping part off the cutting plate.

6. The platen of claim 5, wherein the movable push rod includes a milled button which is rotatable for rotating the clamping part of the stirrup to clamp the cutting plate between the clamping part of the stirrup and the support plate.

7. The platen of claim 6, further comprising a recess in the support plate beneath the moving stirrup for receiving the moving stirrup in the inoperative position thereof.

8. The platen of claim 1, further comprising adjustments blocks on a plurality of the sides of the support plate; and micrometric adjustment elements for micrometric adjustment of the longitudinal position of the respective edge of the support plate at which the adjustment block is located.

9. The platen of claim 8, wherein the adjustment blocks include milled knobs operable for the micrometric adjustment of the position of the edge of the support plate.

10. The platen of claim 8, wherein at least one of the micrometric adjustment elements includes a device for micrometric adjustment of the transverse position of the support plate relative to the platen.

11. The platen of claim 10, wherein the device for micrometric adjustment of the transverse position comprises a milled knob.

12. A blanking platen of a press for shaping sheets, comprising:

a metal cutting plate having a plurality of edges, a bottom beam;

a support plate on the beam, the support plate having a plurality of sides, the support plate being adapted to receive a metal cutting plate, the support plate comprising a first adjusting device for adjusting the position of the support plate on the beam, the cutting plate being movable in any direction on the support plate, and a second adjusting device for fixing the position of the cutting plate on the support plate;

at least one moving stirrup on a first side of the support plate, the moving stirrup including a moveable clamping part which is movable between a clamping position at which the stirrup prevents the cutting plate from sliding on the support plate and an inoperative position at which the stirrup enables the cutting plate to slide on the support plate;

a respective fixed stirrup on a second side of the support plate opposite the first side and also on a third side of the support plate, the fixed stirrups being shaped and positioned so that first and second edges of the cutting plate may be slid into the fixed stirrups and a third edge of the cutting plate may be gripped under the moving stirrup in the clamping position thereof; and a plurality of the fixed stirrups on the second side of the support plate and a plurality of the fixed stirrups on the third side of the support plate, wherein the support plate comprises two of the moving stirrups disposed on the first side of the support plate and each moving stirrup is movable between the positions thereof, and each of the fixed stirrups includes a respective spring strip therein for automatically and accurately positioning the cutting plate on the support plate.

13. A blanking platen of a press for shaping sheets, comprising:

a metal cutting plate having a plurality of edges, a bottom beam;

a support plate on the beam, the support plate having a plurality of sides, the support plate being adapted to receive a metal cutting plate, the support plate comprising a first adjusting device for adjusting the position of the support plate on the beam, the cutting plate being movable in any direction on the support plate, and a second adjusting device for fixing the position of the cutting plate on the support plate;

at least one moving stirrup on a first side of the support plate, the moving stirrup including a moveable clamping part which is movable between a clamping position at which the stirrup prevents the cutting plate from sliding on the support plate and an inoperative position at which the stirrup enables the cutting plate to slide on the support plate;

a respective fixed stirrup on a second side of the support plate opposite the first side and also on a third side of the support plate, the fixed stirrups being shaped and positioned so that first and second edges of the cutting plate may be slid into the fixed stirrups and a third edge of the cutting plate may be gripped under the moving stirrup in the clamping position thereof, wherein the fixed stirrup includes a spring strip therein for automatically and accurately positioning the cutting plate on the support plate.

* * * * *